US006427733B1

(12) United States Patent
Dickhut et al.

(10) Patent No.: US 6,427,733 B1
(45) Date of Patent: Aug. 6, 2002

(54) PORTABLE CUTTER FOR CUT TREE STAND

(75) Inventors: Heinrich B. Dickhut, Charleston; Christopher H. Dickhut, Cleveland; William J. Dickhut, Charleston, all of TN (US)

(73) Assignee: Berens Enterprises Inc., Charleston, TN (US)

( * ) Notice: Subject to any disclaimer, the term of this patent is extended or adjusted under 35 U.S.C. 154(b) by 0 days.

(21) Appl. No.: 09/924,917

(22) Filed: Aug. 8, 2001

(51) Int. Cl.[7] ..... B27F 1/00; B27C 5/00; B25H 1/00

(52) U.S. Cl. ..... 144/85; 144/2.1; 144/136.1; 144/136.7; 144/137; 144/286.5; 144/87; 269/289 R; 248/519

(58) Field of Search ..... 248/519, 523, 248/527; 144/137, 2.1, 134.1, 136.1, 136.7, 136.95, 286.1, 286.5, 85, 87; 269/152, 156, 287, 288, 289 R, 290

(56) References Cited

U.S. PATENT DOCUMENTS 4,067,368 A * 1/1978 Beecroft ..... 144/136.7

5,667,000 A * 9/1997 Bean ..... 144/136.7

FOREIGN PATENT DOCUMENTS

DE 198 43725 C1 * 12/1999

* cited by examiner

*Primary Examiner*—W Donald Bray
(74) *Attorney, Agent, or Firm*—Wood, Phillips, VanSanten, Clark & Mortimer

(57) ABSTRACT

A portable device for cutting stand grooves in the trunk of a cut tree, including a frame, a pair of wheels rotatably secured to one end of the frame, and a hitch fixed to the other end of the frame. A support at the frame one end includes a first trunk support with two support surfaces downwardly tapered together to an intersection to define a notch therebetween for supporting a cut end of a cut tree trunk and a cutting element for cutting stand grooves in a trunk of a supported tree. A horizontal track on the frame extends toward and away from the frame one end support. An upright support member is selectively movable along a track on the frame toward and away from the first trunk support, and secures a second trunk support above the frame for supporting another portion of a cut tree trunk spaced from the cut tree trunk cut end.

15 Claims, 5 Drawing Sheets

PORTABLE CUTTER FOR CUT TREE STAND

BACKGROUND OF THE INVENTION

The present invention is directed toward a cutting grooves in cut trees such as Christmas trees for support stands, and particularly toward a portable device for making such cuts.

Every year, many evergreen trees are cut down and taken to homes where they are supported and decorated for holidays, particularly Christmas. Seasonal sales of such trees are extensive, with large numbers of trees often kept and sold from temporary sale locations such as parking lots. It is often desirable to have the trees stand at their sale locations, not only to better visually display the different sizes and shapes of trees but also to minimize damage to trees which can occur when the trees are laid down for long periods prior to being sold and taken to a home.

Support stands of varying types have been used to support these trees. For example, trees can be supported upright at the point of sale by an "X" cross of boards nailed to the bottom of the tree. While this is simple and relatively inexpensive, such boards must be removed from the tree either by the seller or the purchaser, since the cut tree must get water to keep it from drying out too much during the several holiday weeks when it will be on display (often in a low humidity interior) and the "X" cross of boards would interfere with placing a bottom of the tree trunk in a pan of water to reduce such drying. Further, such boards cannot always be easily properly oriented, resulting in a supported tree which either leans or may be easily knocked over.

Support stands used after the point of sale commonly include a water basin within which the tree trunk bottom is placed, with a support collar supported about the trunk with L-bolts spaced around the collar to adjustably secure the trunk upright inside the collar. However, such support stands require a special purchase and must be stored without any other use during the parts of the year when the stands are not needed.

German Patent No. DE 198 43 725 C1 discloses a tree support structure which overcomes many of the above problems. This structure uses two U-shaped stands secured in grooves cut in the tree, where the grooves and therefore the U-shaped stands are substantially at right angles similar to the "X" cross of boards discussed above to provide full lateral support in keeping the tree upright. However, since the cross-members of this structure are spaced from the bottom of the tree, they will not interfere with the placement of a water basin underneath the tree trunk to keep it from drying out too quickly. Of course, since that basin does then not need to support the tree, it can be any suitable basin which may be put to other uses throughout the year. German Patent No. DE 198 43 725 C1 discloses an apparatus for cutting the grooves in the tree trunk which are used with such tree stands. As illustrated in FIGS. 1 and 2 thereof, a box-shaped frame is provided with orthogonal horizontal and vertical support surfaces at one end for supporting the bottom portion of the tree trunk and two cutting tools supported on slides at that end to cut substantially orthogonal grooves in the tree trunk extending in generally that same direction. A chain hanging from an overhead arm at the other end of the frame supports the other end of the tree so that the tree is in a generally horizontal orientation when the grooves are cut. However, the hung tree end can swing somewhat, and the position of the tree can be affected by a combination of the chain length and the portion of the trunk to which the chain is secured. All of those variables can cause variations in the position of the trunk and therefore the orientation of the grooves relative to the trunk.

The present invention is an improvement upon the apparatus shown in German Patent No. DE 198 43 725 C1 for cutting grooves in trees, such as the grooves which may be used with the support stand disclosed therein.

SUMMARY OF THE INVENTION

In one aspect of the present invention, a device for cutting stand grooves in the trunk of a cut tree is provided, including a frame supportable in a generally horizontal orientation, a first trunk support secured above the frame for supporting a cut end of a cut tree trunk, a cutting element for cutting stand grooves in a trunk of a supported tree adjacent the first trunk support, and an upright support member selectively movable along the frame toward and away from the first trunk support. The upright support member secures a second trunk support above the frame for supporting another portion of a cut tree trunk spaced from the cut tree trunk cut end whereby a cut tree trunk may be substantially horizontally supported above the frame by the first and second trunk supports.

In various forms of this aspect of the invention: the frame includes a substantially horizontal track and the upright support member is movable along the track for positioning the second trunk support at a location clear of branches, the cutting element includes a pair of cutters, and the first trunk support includes two support surfaces downwardly tapered together to an intersection to define a notch therebetween for supporting the cut end of a cut tree trunk (with the two support surfaces defining an angle therebetween of less than 90 degrees, or approximately 60 degrees).

In another form, a hitch for attaching to a vehicle is attached to the frame distal to the cutting element; and wheels are attached to the frame adjacent the cutting element. In still another form, the first and second trunk supports are vertically adjustable to accommodate different size cut trees.

In another aspect, a portable device for cutting stand grooves in the trunk of a cut tree is provided, including a frame, a pair of wheels rotatably secured to one end of the frame, a hitch fixed to the other end of the frame whereby the frame may be attached to a vehicle and pulled on the wheels behind the vehicle, a support at the frame one end including a first trunk support for supporting a cut end of a cut tree trunk and a cutting element for cutting stand grooves in a trunk of a supported tree, a horizontal track on the frame extending toward and away from the frame one end support, and an upright support member selectively movable along the frame toward and away from the first trunk support. The upright support member secures a second trunk support above the frame for supporting another portion of a cut tree trunk spaced from the cut tree trunk cut end whereby a cut tree trunk may be substantially horizontally supported above the frame by the first and second trunk supports.

DETAILED DESCRIPTION OF THE INVENTION

Figure 1:
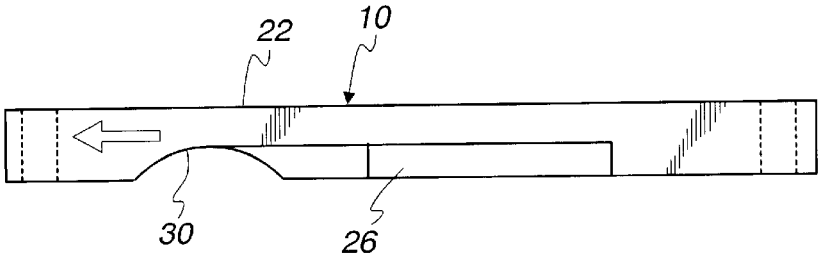
FIG. 1 is a top view of one U-shaped tree stand.
Figure 2:
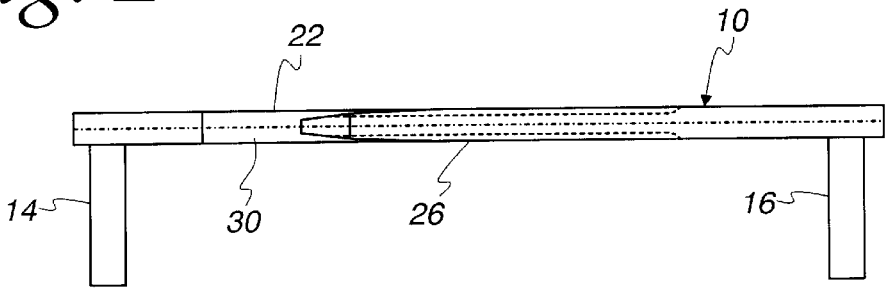
FIG. 2 is a side view of the tree stand of FIG. 1.
Figure 3:
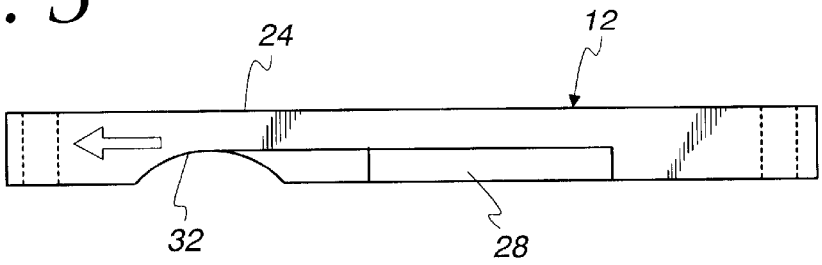
FIG. 3 is a top view of a second U-shaped tree stand.
Figure 4:
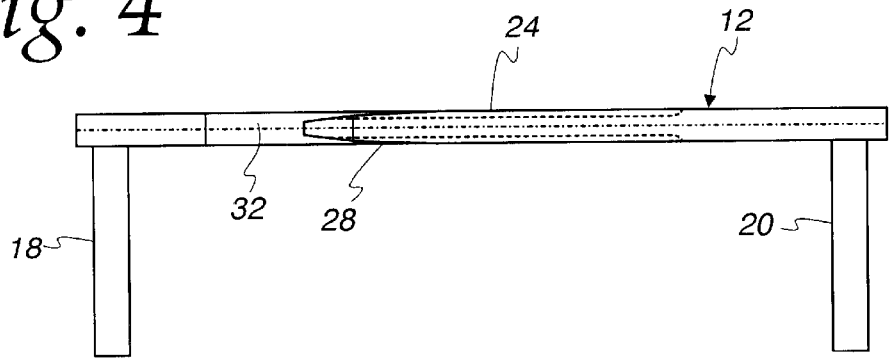
FIG. 4 is a side view of the tree stand of FIG. 3.

Two U-shaped stands 10, 12 usable to support a cut tree such as disclosed in German Patent No. DE 198 43 725 C1 are shown in FIGS. 1–4 (the complete disclosure of German Patent No. DE 198 43 725 C1 is hereby incorporated by reference.

The stands 10, 12 each include two downwardly depending support legs 14, 16 and 18, 20 respectively, where the legs 14, 16 of one stand 10 are shorter than the legs 18, 20 of the other stand 12.

The cross-member 22, 24 of each stand 10, 12 includes a dovetail 26, 28 on a side, with a cut recess 30, 32 at the end of the dovetail 26, 28. It will be understood that the recess 30, 32 enables the dovetail 26, 28 to be aligned with a linear dovetail groove cut into the sides of the round cut tree trunk according to the present invention, with the stands 10, 12 thereby being secured to the trunk of the tree for supporting the tree 40 as shown in FIGS. 5–7.

Figure 5:
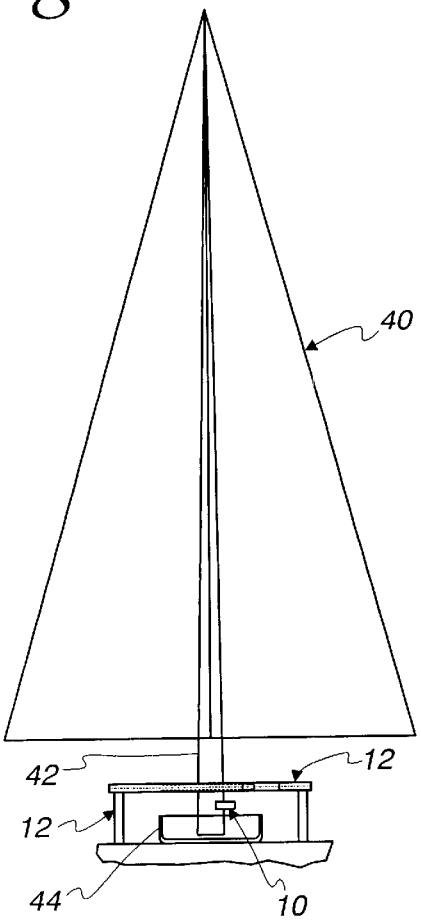
FIG. 5 is a side view of a tree supported by the tree stands of FIGS. 1–4.
Figure 6:
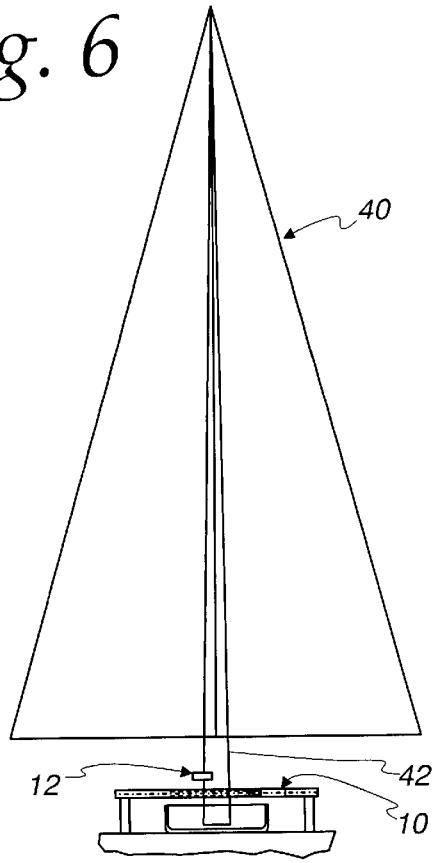
FIG. 6 is a front view of the tree of FIG. 5.
Figure 7:
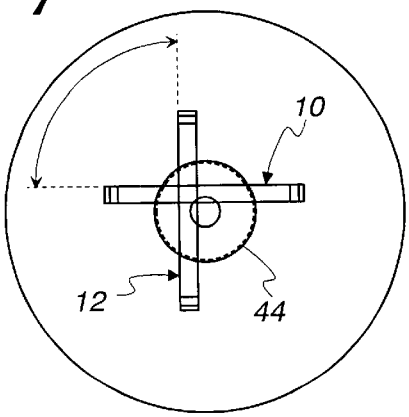
FIG. 7 is a bottom view of the tree and stand of FIG. 6.

Specifically, FIGS. 5–7 show a tree 40 such as a Christmas tree supported by the two stands 10, 12 secured to the tree trunk 42 by engagement of the stand dovetails 26, 28 in substantially orthogonal dovetail grooves in the tree trunk 42. The stand 10 having the shorter legs 14, 16 is secured to a lower point on the tree trunk 42 than the other stand 12 so that all of the legs 14, 16, 18, 20 have substantially even bottoms for supporting the tree 40 on a level surface. Further, the leg bottoms may extend beyond the bottom of the tree trunk 42, allowing the bottom of the trunk 42 to be positioned above a water basin 44 (where the open trunk end is therefore not sealed against absorbing water by being jammed against the bottom of the basin 44).

While it can be seen that the above stands 10, 12 can be advantageously used to support cut trees such as discussed above, it should also be recognized that it is crucial to locate the dovetail grooves in the tree trunk 42 properly. Further, it is important to be able to cut those grooves easily and in various locations where the trees may be sold on a temporary, seasonal basis.

Figure 8:
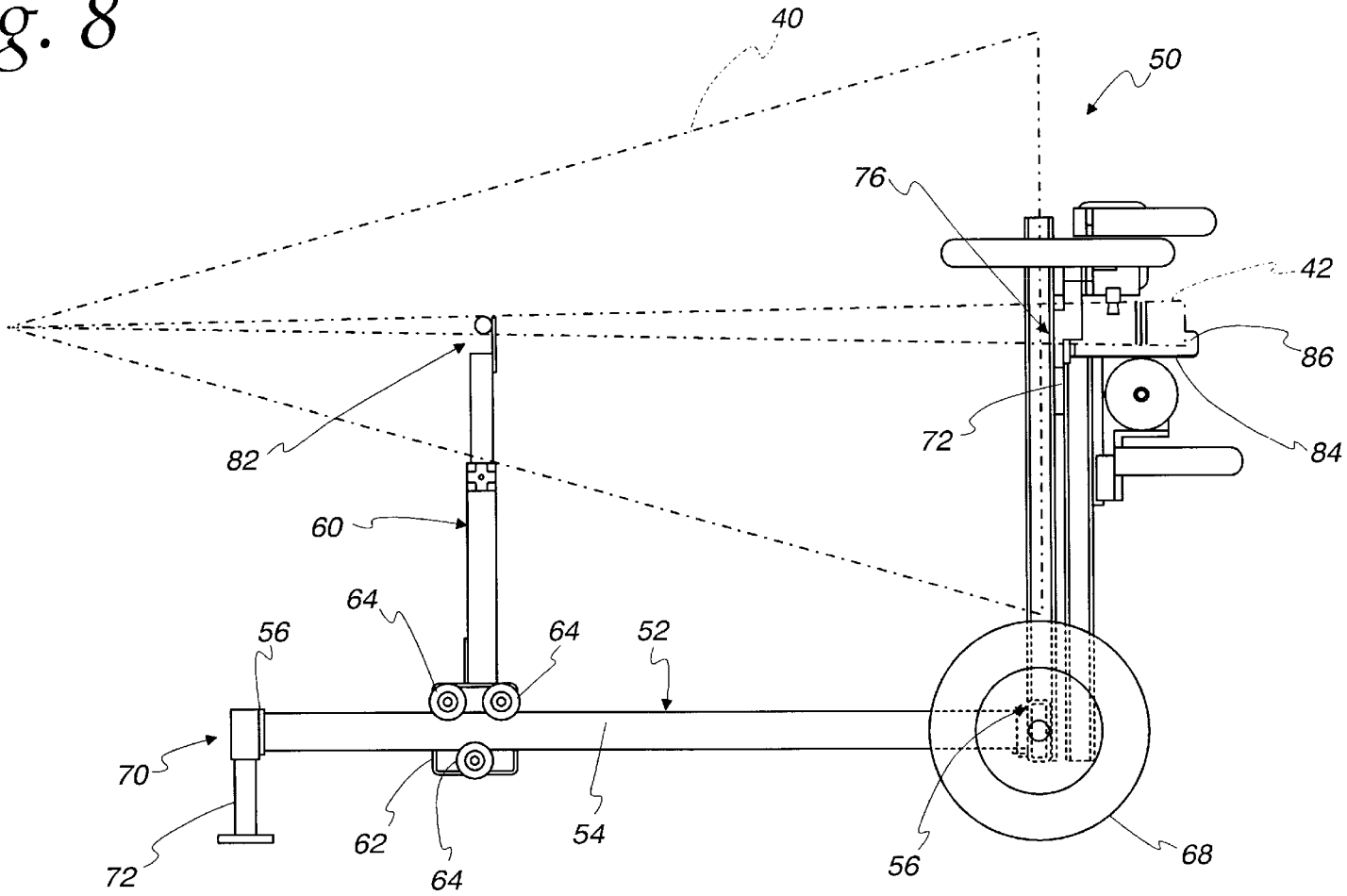
FIG. 8 is a side view of the portable cutter of the present invention.
Figure 9:
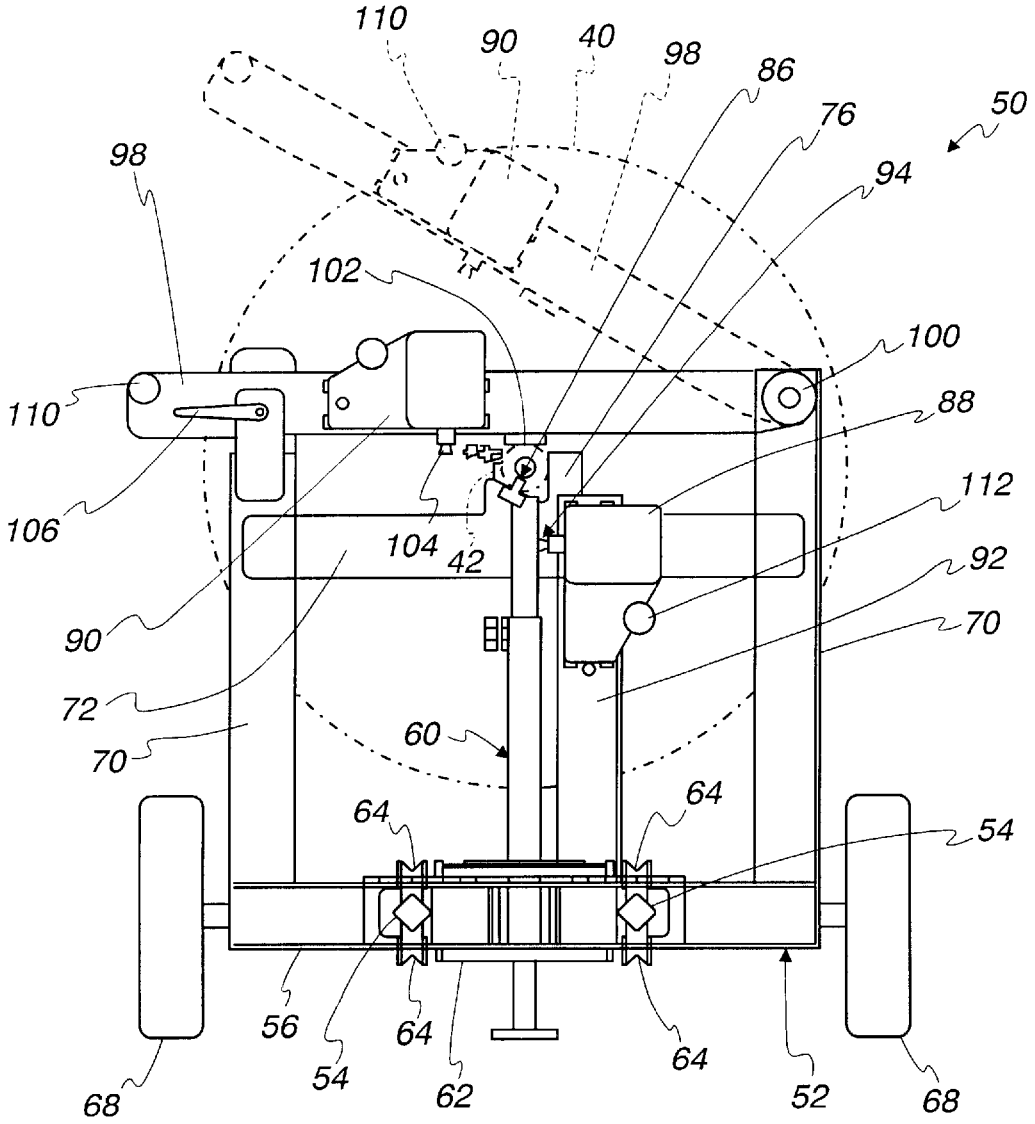
FIG. 9 is an end view of the portable cutter of the present invention.
Figure 10:
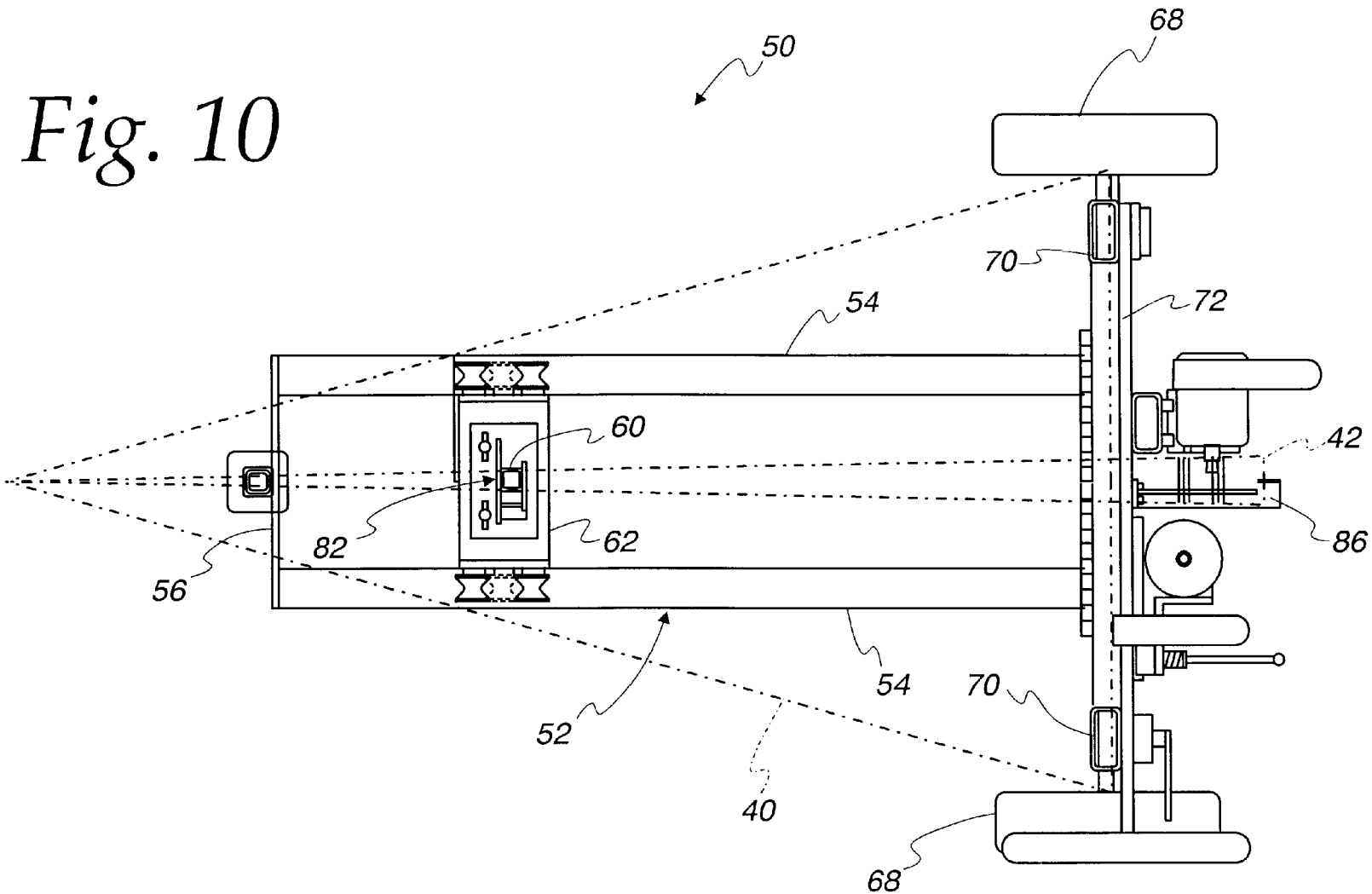
FIG. 10 is a top view of the portable cutter of the present invention.

In accordance with the present invention, a portable cutter 50 for cutting the dovetail grooves in the cut tree trunk 42 is shown in FIGS. 8–10, with the tree 40 shown in phantom.

The cutter 50 includes a frame 52 which is generally horizontal oriented having two parallel spaced beams 54 extending from one end to the other between connecting end members 56.

An upright support 60 is suitably secured to the frame beams 54 for movement between the frame ends. In the illustrated structure, a base 62 extends between the frame beams 54, and is supported on each side by suitable rollers 64. For example, rollers 64 may be provided on opposite sides of the frame beams 54 to securely maintain the orientation of the base 62 and the upright support 60 secured thereon, whereby motion is only in the a direction parallel to the beams 54.

Wheels 68 are rotatably secured to one end of the frame 52, to opposite sides of the end member 56 on the cutting end. The opposite frame end is includes a suitable connector 70, such as a hitch connector, so that the cutter 50 may be suitably secured to a vehicle or the like and pulled behind to transport it from one location to another. A support leg 72 may also be provided for securing to the frame 52, as to the connector 70, so that the frame 52 may be maintained generally horizontal during use when not connected to a vehicle hitch.

Figure 9A:
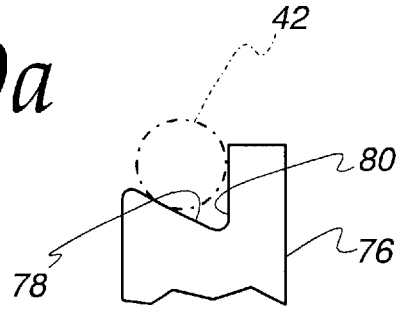
FIG. 9A is an enlarged end view of the first trunk support of the cutter of the present invention.

The cutting end includes a pair of vertical members 70 secured on opposite sides of the end member 56. A cross support 72 extends between the vertical members 70 and includes a first trunk support 76. As best seen in FIG. 9A, the trunk support 76 includes a pair of surfaces 78, 80 at an acute angle to each other (such as 60 degrees) to form a notch therebetween, with one of the surfaces 80 being substantially vertically oriented. It should be understood, however, that other configurations of the trunk support 76 could also be used. For example, neither of the surfaces need to be vertical. Further, where the notch between the surfaces is at a low point (that is, neither of the surfaces slope up to the notch but instead both slope down toward the notch), the angle therebetween need not be acute.

A second trunk support 82 is secured to the top of the upright support 60. It too may have facing surfaces defining a notch, though the relative orientation of the surfaces are not subject to the same constraints as the surfaces 78, 80 of the first trunk support 76 as will be explained further hereafter.

Extending rearwardly from the cross support 72 is a stop arm 84 with a stop 86 on its rear end. It will thus be appreciated that a cut tree 40 may be positioned on the cutter 50 with the cut end at a specific position relative to the frame 50, and that the tree 40 may be positioned in an essentially horizontal orientation. It should also be appreciated that the front support (at the second trunk support 82) may be moved to a convenient location relative to each tree 40 while still maintaining the above positioning. For example, if the tree 40 being cut has branches located at a particular location along the trunk 42 which would prevent the second trunk support 82 from reaching the trunk 42, the upright support 60 may be moved to a different location where it can properly support that end of the trunk 42 whereby the tree 40 is maintained in the horizontal orientation as is desired.

Also secured to the cutting end of the cutter 50 are a pair of cutting tools such as routers 88, 90 for cutting the dovetail grooves in the tree trunk 42. A first router 88 is slidably mounted on a vertical support 92 with the cutting element 94 oriented so that it will cut at a particular depth parallel to the first trunk support surface 80. The second router 90 is slidably mounted to an arm 98 pivotally secured at 100 to one of the vertical members 70.

The arm 98 may be pivoted away from the first trunk support 76 as shown in the upper displayed position in FIG. 9 to allow the tree trunk 42 to be easily dropped into position from the top, and then pivoted back down on top of the trunk 42 (as shown in the lower displayed position in FIG. 9) for cutting. A suitable stop or step may be provided to secure the arm 98 in an upper pivoted position to keep it clear and out of the way when a single user loads a tree 40 in the cutter 50.

A positioning plate 102 secured to the arm 98 engages the top of a supported tree trunk 42 to orient the cutting element 104 of the second router 90 for proper cutting of the second dovetail groove in the trunk 42 at substantially right angles to the dovetail groove cut by the first router 88. Of course, it should be understood that different orientations of the routers 88, 90 could also be used. For example, the routers 88, 90 could be oriented to cut at other than vertical and horizontal directions such as occurs with the embodiment shown in the drawings, with the only limitation being the desire for the cuts to be generally (but not necessarily exactly) orthogonal to each other to ensure proper positioning of the stands 10, 12 when secured in the cut grooves. As a further example, the surfaces of the first trunk support could be each sloped down at a 45 degree angle to a notch, with the routers 88, 90 mounted to slide along parallel sloped paths for cutting the grooves in the trunk 42.

A locking handle 106 may also be provided on the other vertical member 70 to suitably secure the arm 98 (for example, by a wedging frictional action) in the cutting position to prevent it from kicking up when cutting.

A large convenient handle 110, 112 may be provided with each of the routers 88, 90 to enable a user to easily manipulate the routers 88, 90 for cutting the dovetail grooves. However, it should be understood that the routers 88, 90 could also be moved along the vertical support 92 and arm 98 respectively by other means, including drive motors.

It should be appreciated that this support system will enable the dovetail grooves to be easily and reliably cut in the tree trunk at precisely the proper orientation, with the grooves not only sufficiently spaced from the trunk end so that the bottoms of the stand legs 14, 16, 18, 20 will extend beyond the trunk end as desired, but will also ensure that the grooves will be oriented at right angles to the longitudinal direction of the trunk so that the stands 10, 12 will support the trunk upright without any significant lean to one side or the other (which lean could result in the supported tree being unstable and possibly toppling over). Further, it should be appreciated that the unitary portable nature of the cutter 50 will enable it to be easily and conveniently used at the many disparate sites where it might be desired, since it can be easily moved from one location to another and quickly set up for proper use. Still further, it should be appreciated that the movable upright support 60 enables this to be accomplished with virtually any tree no matter what its configuration, since the second trunk support 82 thereon may be properly positioned no matter what the relationship of the tree branches relative to the trunk bottom, which proper trunk positioning is essential to ensuring the proper orientation of the dovetail grooves relative to the trunk as discussed above. Additionally, the configuration of the first trunk support 76 allows the trunk 42 to be reliably secured in a desired orientation during cutting whereby the trunk 42 will not roll or move around, which movement would negatively impact the proper positioning of the grooves being cut.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A device for cutting stand grooves in the trunk of a cut tree, comprising:

a frame supportable in a generally horizontal orientation;

a first trunk support secured above said frame for supporting a cut end of a cut tree trunk;

an upright support member selectively movable along said frame toward and away from said first trunk support, said upright support member securing a second trunk support above said frame for supporting another portion of a cut tree trunk spaced from said cut tree trunk cut end whereby a cut tree trunk may be substantially horizontally supported above said frame by said first and second trunk supports; and a cutting element for cutting stand grooves in a trunk of a supported tree adjacent said first trunk support.

2. The device of claim 1, wherein said frame includes a substantially horizontal track and said upright support member is movable along said track for positioning said second trunk support at a location clear of branches.

3. The device of claim 1, wherein said cutting element includes a pair of cutters.

4. The device of claim 1, wherein said first trunk support includes two support surfaces downwardly tapered together to an intersection to define a notch therebetween for supporting the cut end of a cut tree trunk.

5. The device of claim 4, wherein said two support surfaces define an angle therebetween of less than 90 degrees.

6. The device of claim 4, wherein said two support surfaces define an angle therebetween of approximately 60 degrees.

7. The device of claim 1, further comprising:

a hitch for attaching to a vehicle, said hitch being attached to said frame distal to said cutting element; and wheels attached to said frame adjacent said cutting element.

8. The device of claim 1, wherein said first and second trunk supports are vertically adjustable to accommodate different size cut trees.

9. A portable device for cutting stand grooves in the trunk of a cut tree, comprising:

a frame;

a pair of wheels rotatably secured to one end of said frame;

a hitch fixed to the other end of said frame whereby said frame may be attached to a vehicle and pulled on said wheels behind said vehicle;

a support at said frame one end including a first trunk support for supporting a cut end of a cut tree trunk, and a cutting element for cutting stand grooves in a trunk of a supported tree;

a horizontal track on said frame extending toward and away from said frame one end support; and an upright support member selectively movable along said frame toward and away from said first trunk support, said upright support member securing a second trunk support above said frame for supporting another portion of a cut tree trunk spaced from said cut tree trunk cut end whereby a cut tree trunk may be substantially horizontally supported above said frame by said first and second trunk supports.

10. The portable device of claim 8, wherein said frame is generally horizontal.

11. The portable device of claim 8, wherein said first and second trunk supports are vertically adjustable.

12. The portable device of claim 8, wherein said cutting element includes a pair of cutters.

13. The portable device of claim 8, wherein said first trunk support includes two support surfaces downwardly tapered together to an intersection to define a notch therebetween for supporting the cut end of a cut tree trunk.

14. The portable device of claim 12, wherein said two support surfaces define an angle therebetween of less than 90 degrees.

15. The portable device of claim 12, wherein said two support surfaces define an angle therebetween of approximately 60 degrees.

* * * * *